US011015552B2

(12) United States Patent
Honda et al.

(10) Patent No.: US 11,015,552 B2
(45) Date of Patent: May 25, 2021

(54) EVAPORATED FUEL PROCESSING APPARATUS

(71) Applicant: AISAN KOGYO KABUSHIKI KAISHA, Obu (JP)

(72) Inventors: Yoshihiko Honda, Obu (JP); Hironori Suzuki, Obu (JP); Hiroyuki Takahashi, Nagoya (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 16/553,228

(22) Filed: Aug. 28, 2019

(65) Prior Publication Data

US 2020/0072166 A1 Mar. 5, 2020

(30) Foreign Application Priority Data

Sep. 5, 2018 (JP) ..... JP2018-166000

(51) Int. Cl.
*F02M 25/08* (2006.01)

(52) U.S. Cl.
CPC ..... *F02M 25/0836* (2013.01)

(58) Field of Classification Search
CPC ..... F02M 25/0836; F02M 25/089
USPC ..... 123/516
See application file for complete search history.

(56) References Cited

U.S. PATENT DOCUMENTS

2002/0066440 A1* 6/2002 Kano ..... F02M 25/089 123/520
2002/0139173 A1* 10/2002 Kano ..... F02M 25/089 73/49.7
2007/0119427 A1* 5/2007 Murakami ..... F02M 25/0818 123/520
2017/0184057 A1 6/2017 Weigl et al.

FOREIGN PATENT DOCUMENTS

JP 6168007 B2 7/2017

* cited by examiner

*Primary Examiner* — Joseph J Dallo
*Assistant Examiner* — Yi-Kai Wang
(74) *Attorney, Agent, or Firm* — Oliff PLC

(57) ABSTRACT

An evaporated fuel processing apparatus includes a canister to collect vapor generated in a fuel tank, a purge passage to purge vapor into an intake passage from the canister, a purge pump provided in the purge passage, a first trifurcated valve in the purge passage between an exhaust port of the purge pump and an outflow port of the purge passage, a second trifurcated valve provided in the purge passage between an inflow port of the purge passage and an intake port of the purge pump, a first bypass passage between the purge passage upstream of the second trifurcated valve and the first trifurcated valve, and a second bypass passage between the purge passage downstream of the first trifurcated valve and the second trifurcated valve. Passages for the vapor and others are switched by switching the first trifurcated valve and the second trifurcated valve during operation of the purge pump.

17 Claims, 8 Drawing Sheets

EVAPORATED FUEL PROCESSING APPARATUS

CROSS-REFERENCE TO RELATED APPLICATIONS

This application is based upon and claims the benefit of priority from the prior Japanese Patent Application No. 2018-166000, filed Sep. 5, 2018, the entire contents of which are incorporated herein by reference.

BACKGROUND

Technical Field

The technique disclosed in this specification relates to an evaporated fuel processing apparatus to purge evaporated fuel generated in a fuel tank to an intake passage.

Related Art

Heretofore, as this type of technique, for example, a technique described in US 2017/0184057 A1 has been known. This technique is configured such that air-tightness of a fuel tank system is periodically checked during operation of an automobile (an engine). Particularly, this technique provides a configuration including a valve unit configured with a plurality of pipes and a plurality (six) of valves, a storage element (a canister) storing hydrocarbon (evaporated fuel) that is generated in a fuel tank, a purge air pump (a purge pump) to convey fresh air into the canister, and a movable adjustment element (a valve cylinder) having at least two positions. The valve cylinder includes first to fourth passages in which a first passage is connected to a first line on a pressure side of the purge pump, a second passage is connected to a second line on a suction side of the purge pump, a third passage is connected to the second line on the pressure side of the purge pump, and a fourth passage is connected to the first line on the suction side of the purge pump.

SUMMARY

Technical Problems

In the technique described in US 2017/0184057 A1, since the valve unit is configured with a plurality of pipes and a plurality of valves, each connection of those pipes to the valve cylinder is complicated and the number of the valves is large, resulting in complication of switching control of each valve when the evaporated fuel is purged to the intake passage. Further, halt in purging the evaporated fuel leads to halt in flow of the evaporated fuel in a pipe, so that air cannot flow in the purge pump and the plurality of valves, and thus the heat in the purge pump (a motor) becomes hard to escape. The excess heat may accordingly get stuck in the purge pump, and this could cause heat damage in the purge pump. Furthermore, for prevention of disturbance in the air-fuel ratio of the engine, it is necessary to improve responsivity in purging halt of the evaporated fuel to the intake passage. The above technique has no any special consideration of improving the responsivity in purging halt.

The present disclosure has been made in view of the above circumstances, and has a purpose of providing an evaporated fuel processing apparatus with a relatively simple configuration including a purge air pump, the apparatus being configured to cool down not only a passage for purging evaporated fuel into an intake passage but also a purge pump during purging halt and to switch passages for improving responsivity in purging halt.

Means of Solving the Problems

A first aspect of the present disclosure for achieving the above object is to provide an evaporated fuel processing apparatus to purge and process evaporated fuel generated in a fuel tank to an intake passage of an engine, the evaporated fuel processing apparatus comprising: a canister to collect the evaporated fuel generated in the fuel tank; a purge passage to purge the evaporated fuel collected in the canister to the intake passage, the purge passage including an inflow port to introduce the evaporated fuel from the canister and an outflow port to discharge the evaporated fuel out of the intake passage, a purge pump arranged in the purge passage to pressure-feed the evaporated fuel collected in the canister to the purge passage, the purge pump including an intake port and an exhaust port and configured to intake the evaporated fuel collected in the canister from the intake port and to discharge the evaporated fuel from the exhaust port; a first trifurcated valve arranged in the purge passage between the exhaust port of the purge pump and the outflow port of the purge passage; a second trifurcated valve arranged in the purge passage between the inflow port of the purge passage and the intake port of the purge pump; a first bypass passage detouring the purge pump between the purge passage upstream of the second trifurcated valve and the first trifurcated valve; and a second bypass passage detouring the purge pump between the purge passage downstream of the first trifurcated valve and the second trifurcated valve, wherein passages of the evaporated fuel or the air passing through at least any one of the purge passage, the first bypass passage, and the second bypass passage are configured to be switched by switching passages of the first trifurcated valve and the second trifurcated valve during operation of the purge pump.

A second aspect of the present disclosure for achieving the above object is to provide an evaporated fuel processing apparatus to purge and process evaporated fuel generated in a fuel tank to an intake passage of an engine, the evaporated fuel processing apparatus comprising: a canister to collect the evaporated fuel generated in the fuel tank; a purge passage to purge the evaporated fuel collected in the canister to the intake passage, the purge passage including an inflow port to introduce the evaporated fuel from the canister and an outflow port to discharge the evaporated fuel out of the intake passage, a purge pump arranged in the purge passage to pressure-feed the evaporated fuel collected in the canister to the purge passage, the purge pump including an intake port and an exhaust port and configured to intake the evaporated fuel collected in the canister from the intake port and to discharge the evaporated fuel from the exhaust port; a first trifurcated valve arranged in the purge passage between the exhaust port of the purge pump and the outflow port of the purge passage; a second trifurcated valve arranged in the purge passage between the inflow port of the purge passage and the intake port of the purge pump; a third bypass passage detouring the purge pump between the canister and the first trifurcated valve; and a second bypass passage detouring the purge pump between the purge passage downstream of the first trifurcated valve and the second trifurcated valve, wherein passages of the evaporated fuel or the air passing through at least any one of the purge passage, the third bypass passage, and the second bypass passage are configured to be switched by switching passages of the first trifurcated valve and the second trifurcated valve during operation of the purge pump.

According to the above first and second aspects, by a relatively simple configuration including the purge pump, it is achieved to switch not only a passage capable of purging the evaporated fuel to the intake passage but also a passage capable of cooling down the purge pump during purging halt and of improving the responsivity of the purging halt.

DETAILED DESCRIPTION OF THE EXEMPLARY EMBODIMENTS

First Embodiment

A first embodiment embodying an evaporated fuel processing apparatus is now explained below with reference to the accompanying drawings.

(Overview of Engine System)

Figure 1:
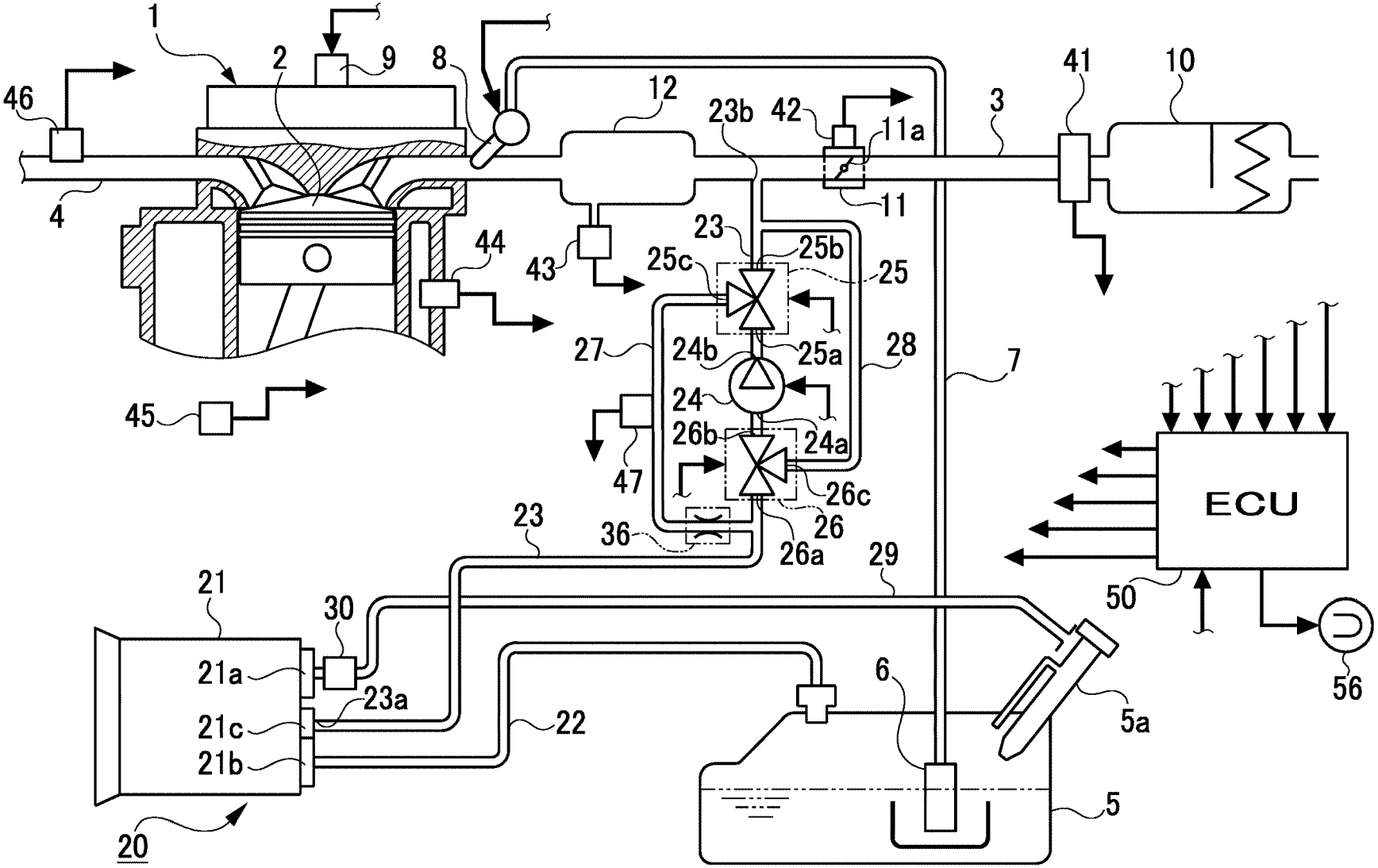
FIG. 1 is a schematic configurational view showing an engine system including an evaporated fuel processing apparatus mounted in a vehicle in a first embodiment.

FIG. 1 is a schematic configurational view of an engine system including an evaporated fuel processing apparatus 20 mounted in a vehicle. An engine 1 is provided with an intake passage 3 to take air and others into a combustion chamber 2 and an exhaust passage 4 to discharge exhaust gas from the combustion chamber 2. To the combustion chamber 2, fuel stored in a fuel tank 5 is supplied. Specifically, the fuel in the fuel tank 5 is discharged to a fuel passage 7 by a fuel pump 6 embedded in the fuel tank 5 and then pressure-fed to an injector 8 provided in an intake port of the engine 1. The thus fed fuel is injected through the injector 8 and introduced in the combustion chamber 2 with air having been flowing through the intake passage 3 to form combustible air-fuel mixture that is to be used for combustion. The engine 1 is provided with an ignition device 9 for igniting the combustible air-fuel mixture.

In the intake passage 3, there are provided an air cleaner 10, a throttle device 11, and a surge tank 12 in this order from an inlet side to an engine 1 side. The throttle device 11 is provided with a throttle valve 11*a* which is opened or closed to regulate an intake flow rate of intake air flowing in the intake passage 3. Opening and closing operation of the throttle valve 11*a* is associated with operation of an accelerator pedal (not shown) operated by a driver. The surge tank 12 smoothens intake pulsation in the intake passage 3.

(Configuration of Evaporated Fuel Processing Apparatus)

In FIG. 1, the evaporated fuel processing apparatus 20 of the present embodiment is configured to process the evaporated fuel (vapor) generated in the fuel tank 5 without discharging into the air. This apparatus 20 is provided with a canister 21 to collect the vapor generated in the fuel tank 5, a vapor passage 22 to introduce the vapor into the canister 21 from the fuel tank 5, a purge passage 23 to purge the vapor collected in the canister 21 to the intake passage 3, a purge pump 24 provided in the purge passage 23 to pressure-feed the vapor collected in the canister 21 to the purge passage 23, a first trifurcated valve 25 provided in the purge passage 23 downstream of the purge pump 24, a second trifurcated valve 26 provided in the purge passage 23 upstream of the purge pump 24, a first bypass passage 27 arranged to detour the purge pump 24 between the purge passage 23 upstream of the second trifurcated valve 26 and the first trifurcated valve 25, and a second bypass passage 28 arranged to detour the purge pump 24 between the purge passage 23 downstream of the first trifurcated valve 25 and the second trifurcated valve 26. In the present embodiment, the first bypass passage 27 is provided with an aperture 36 in a vicinity of connection part with the purge passage 23. This aperture 36 is configured to narrow a flow passage area of the first bypass passage 27.

The purge passage 23 includes an inflow port 23*a* to introduce vapor from the canister 21 and an outflow port 23*b* to discharge the vapor to the intake passage 3. The purge pump 24 includes an intake port 24*a* and an exhaust port 24*b* and is configured to take in the vapor collected in the canister 21 through the intake port 24*a* and discharge the vapor out of the exhaust port 24*b*. The first trifurcated valve 25 is provided in the purge passage 23 between the exhaust port 24*b* of the purge pump 24 and the outflow port 23*b* of the purge passage 23. The second trifurcated valve 26 is provided in the purge passage 23 between the inflow port 23*a* of the purge passage 23 and the intake port 24*a* of the purge pump 24. When the purge pump 24 is operated, the evaporated fuel processing apparatus 20 is configured such that passages of the first trifurcated valve 25 and the second trifurcated valve 26 are appropriately switched to switch (select) a passage of the vapor or the air passing through at least any one of the purge passage 23, the first bypass passage 27, and the second bypass passage 28. Herein, in a portion of the purge passage 23 connected to the intake port 24*a* of the purge pump 24, the vapor is sucked into the purge pump 24 by the negative pressure, and in a portion of the purge passage 23 connected to the exhaust port 24*b* of the purge pump 24, the vapor is pushed out from the purge pump 24 by the positive pressure. A term "pressure-feed" by the purge pump 24 is defined to include the push-out operations by both the negative pressure and the positive pressure.

The canister 21 internally includes an absorbent such as an activated carbon. The canister 21 includes an atmospheric port 21*a* to introduce the air, an inflow port 21*b* to introduce the vapor, and an outflow port 21*c* to discharge the vapor. A space inside the canister 21 is communicated with the atmosphere. To be specific, a leading end of an atmospheric passage 29 extending from the atmospheric port 21*a* is communicated with an inlet of a fuel-supply cylinder 5*a* of the fuel tank 5. In this atmospheric passage 29, a filter 30 for capturing mine dust in the air is provided. A leading end of the vapor passage 22 extending from the inflow port 21*b* of the canister 21 is communicated with an inside of the fuel tank 5. The inflow port 23*a* of the purge passage 23 is connected with the outflow port 21*c* of the canister 21, and the outflow port 23*b* of the purge passage 23 is connected to the intake passage 3 between the throttle device 11 and the surge tank 12.

In the present embodiment, each of the trifurcated valves 25 and 26 is constituted of an electrically-operated valve and is configured to switch passages as mentioned below. The first trifurcated valve 25 includes an inlet 25*a* and a first outlet 25*b* which are connected to the purge passage 23 and a second outlet 25*c* connected to the first bypass passage 27. The first trifurcated valve 25 is configured to switch passages to a first communication state of communicating the inlet 25*a* with the first outlet 25*b* and to a second communication state of communicating the inlet 25*a* with the second outlet 25*c*. In the present embodiment, the first trifurcated valve 25 is turned "ON" to switch the state to the first communication state, and the first trifurcated valve 25 is turned "OFF" to switch the state to the second communication state. Further, the second trifurcated valve 26 includes a first inlet 26*a* and an outlet 26*b* which are connected to the purge passage 23 and a second inlet 26*c* connected to the second bypass passage 28. The second trifurcated valve 26 is configured to switch passages to a first communication state of communicating the outlet 26*b* with the second inlet 26*c* and to a second communication state of communicating the first inlet 26*a* with the outlet 26*b*. In the present embodiment, the second trifurcated valve 26 is turned "ON" to switch the state to the first communication state, and the second trifurcated valve 26 is turned "OFF" to switch the state to the second communication state.

In the present embodiment, the purge pump 24 is configured to be variable in its exhaust amount of the vapor to be pressure-fed to the purge passage 23 from the canister 21. Further, the purge pump 24 is constituted of a centrifugal pump to flow the vapor or the air to one direction from the intake port 24*a* to the exhaust port 24*b*.

(Electrical Configuration of Engine System)

In the present embodiment, various sensors 41 to 46 for detecting an operation state of the engine 1 are provided. An air flow meter 41 provided near the air cleaner 10 detects an amount of air taken in the intake passage 3 as an intake-air flow rate and outputs an electrical signal corresponding to the detected value. A throttle sensor 42 provided in the throttle device 11 detects an open degree of the throttle valve 11*a* as a throttle opening degree and outputs an electrical signal corresponding to the detected value. An intake pressure sensor 43 provided in the surge tank 12 detects pressure in the surge tank 12 as an intake air pressure and outputs an electrical signal corresponding to the detected value. A water temperature sensor 44 provided in the engine 1 detects a temperature of cooling water flowing inside the engine 1 as a cooling-water temperature and outputs an electrical signal corresponding to the detected value. A rotation speed sensor 45 provided in the engine 1 detects rotation angular speed of a crank shaft (not shown) of the engine 1 as an engine rotation speed and outputs an electrical signal corresponding to the detected value. An oxygen sensor 46 provided in the exhaust passage 4 detects oxygen concentration in the exhaust gas and outputs an electrical signal corresponding to the detected value.

Further in the present embodiment, a pressure sensor 47 to detect the pressure in the first bypass passage 27 between the first trifurcated valve 25 and the aperture 36 is provided. This pressure sensor 47 outputs an electrical signal corresponding to the detected pressure value.

Further, a driver's seat of a vehicle is provided with a warning lamp 56 to notify abnormality of the evaporated fuel processing apparatus 20. The warning lamp 56 is configured to light on when the evaporated fuel processing apparatus 20 is in an abnormal state (such as leakage in a pipe or malfunction of the trifurcated valves 25 and 26).

In the present embodiment, an electronic control unit (ECU) 50 being in charge of various controls is configured to input or receive various signals that are output from the respective sensors 41 to 47. The ECU 50 controls the injector 8, the ignition device 9, the purge pump 24, the first trifurcated valve 25, and the second trifurcated valve 26 based on these input signals to carry out each of fuel injection control, ignition timing control, purge control, vapor-concentration estimation control, and abnormality diagnosis control of the evaporated fuel processing apparatus 20.

Herein, the fuel injection control is to control a fuel injection amount and fuel injection timing by controlling the injector 8 according to an operation state of the engine 1. The ignition timing control is to control timing for igniting the combustible air-fuel mixture by controlling the ignition device 9 according to the operation state of the engine 1.

In the present embodiment, the purge control is performed by the ECU 50 by controlling the purge pump 24, the first trifurcated valve 25, and the second trifurcated valve 26 according to the operation state of the engine 1 such that the vapor collected in the canister 21 is purged to the intake passage 3 only through the purge passage 23 (execution of the purge mode), the vapor or the air is circulated between the purge passage 23 and the first bypass passage 27 (execution of the idle mode), and the vapor purged into the intake passage 3 is made to flow backward through the purge passage 23, the first bypass passage 27, and the second bypass passage 28 (execution of the backflow mode).

The vapor concentration estimation control is to estimate the vapor concentration based on the detected value of the pressure sensor 47 provided in the first bypass passage 27, and other detected values. The abnormality diagnosis control is to determine abnormality of the evaporated fuel processing apparatus 20 similarly based on the detected values of the pressure sensor 47 and others.

In the present embodiment, the ECU 50 corresponds to one example of a control unit of the present disclosure. The ECU 50 is provided with a known configuration including a central processing unit (CPU), a read-only memory (ROM), a random-access memory (RAM), and a back-up RAM. The ROM stores in advance predetermined control programs related to the above-mentioned various control operations. The ECU (CPU) 50 is configured to carry out the above-mentioned various controls according to these programs.

In the present embodiment, known configurations are adopted for the fuel injection control and the ignition timing control while the purge control, the vapor concentration estimation control, and the abnormality determination control are explained in detail below.

(Purge Control)

Figure 2:
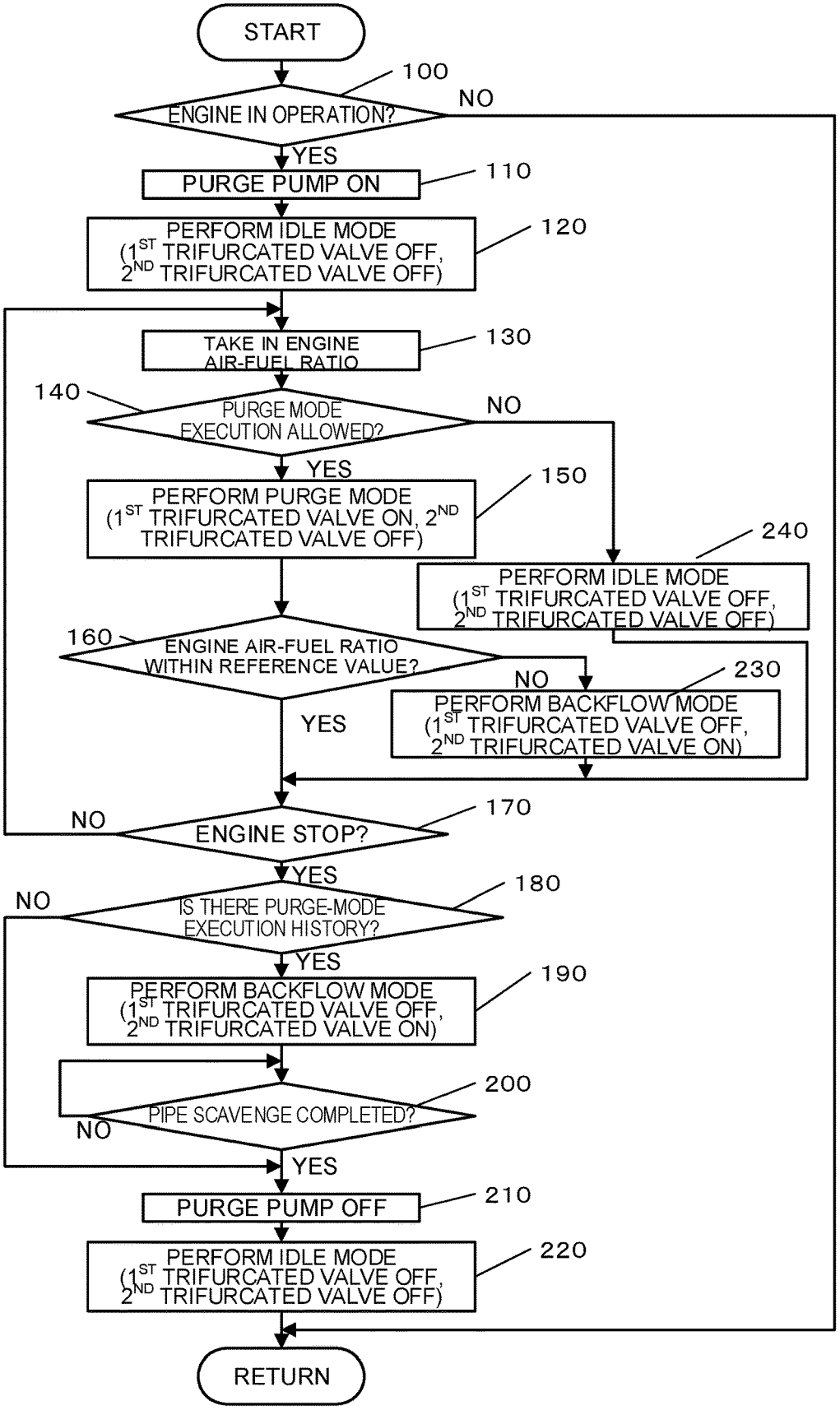
FIG. 2 is a flow chart showing a content of purge control in the first embodiment.

Firstly, the purge control is explained. FIG. 2 is a flow chart showing a control content of the purge control. The ECU 50 periodically carries out this routine per predetermined period of time.

When the process shifts to this routine, in step 100, the ECU 50 determines whether the engine 1 is under operation. The ECU 50 can make this determination based on the detected values detected by the various sensors 41 to 46. The ECU 50 shifts the process to step 110 when this determination result is affirmative, and returns the process to step 100 when the determination result is negative, namely, when the engine 1 is stopped.

In step 110, the ECU 50 turns on the purge pump 24, specifically, operates the purge pump 24.

Next, in step 120, the ECU 50 carries out the "idle mode" to, for example, cool down the purge pump 24. This idle mode is made to circulate the vapor or the air through the purge passage 23 and the first bypass passage 27, and thus the ECU 50 turns off the first trifurcated valve 25 and turns off the second trifurcated valve 26.

Figure 3:
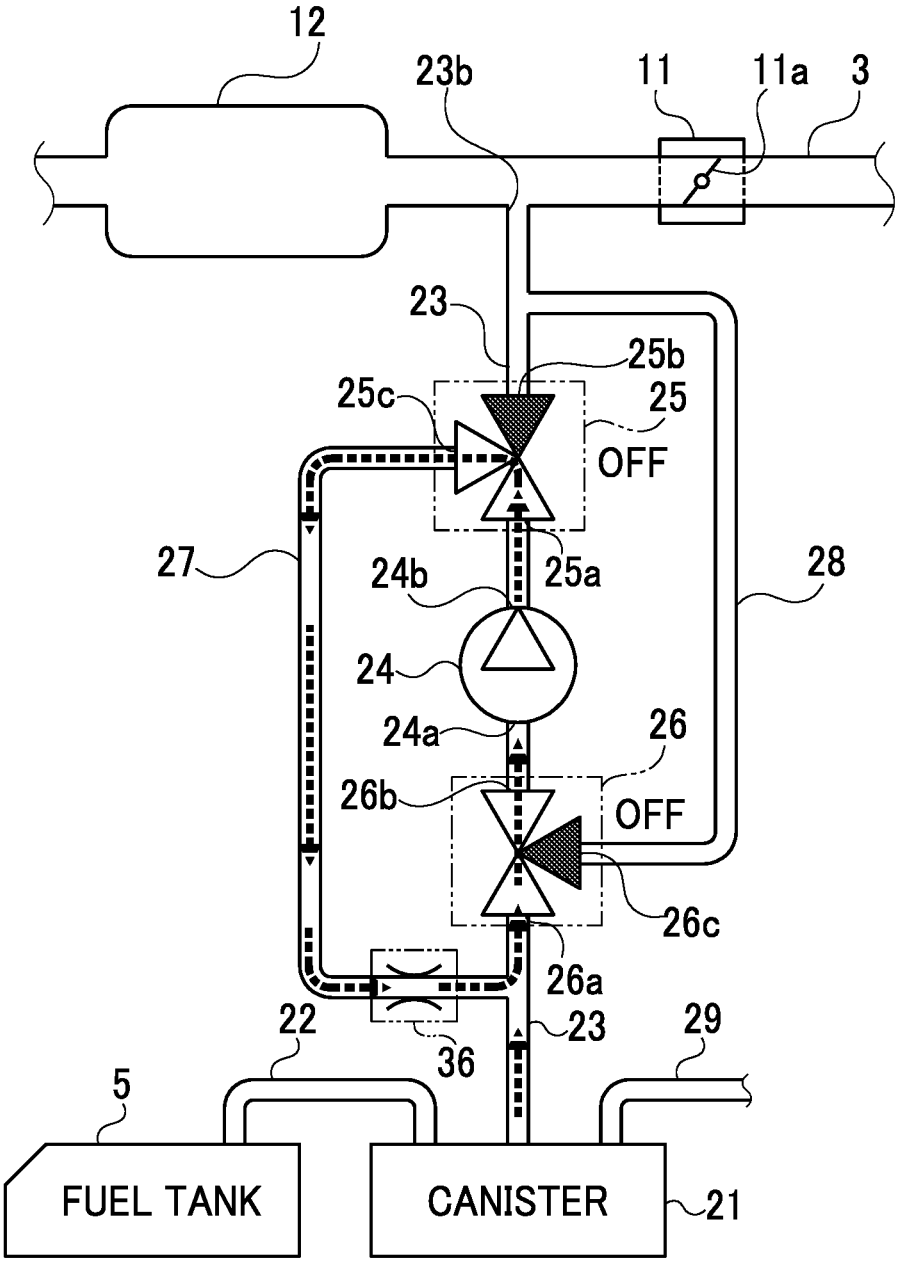
FIG. 3 is a schematic view showing a flow of vapor and others in the evaporated fuel processing apparatus in an idle mode state in the first embodiment.

FIG. 3 is a schematic view showing a flow of the vapor or the like (indicated with an arrow) in the evaporated fuel processing apparatus 20 under the idle mode state. As shown in FIG. 3, the vapor having been flown out of the canister 21 to the purge passage 23 flows into the first bypass passage 27 through the second trifurcated valve 26, the purge pump 24, and the first trifurcated valve 25. The vapor further flows in the purge passage 23 upstream of the second trifurcated valve 26 and is merged with the vapor having been flowing in the same portion of the purge passage 23 so that the vapor circulates the above-mentioned route of flow.

In step 130, the ECU 50 takes in an engine air-fuel ratio. The ECU 50 can separately obtain the engine air-fuel ratio based on a detected value of the oxygen sensor 46.

In step 140, the ECU 50 determines whether execution of the purge mode is allowed. The ECU 50 is configured to perform the purge mode operation when a predetermined purging condition is established for the engine 1. The ECU 50 shifts the process to step 150 when this determination result is affirmative, and shifts the process to step 240 when the determination result is negative.

In step 240, the ECU 50 carries out the idle mode operation similarly to step 120 and shifts the process to step 170.

In step 150, on the other hand, the ECU 50 carries out the "purge mode" to purge the vapor to the intake passage 3. The ECU 50 thus turns on the first trifurcated valve 25 and turns off the second trifurcated valve 26.

Figure 4:
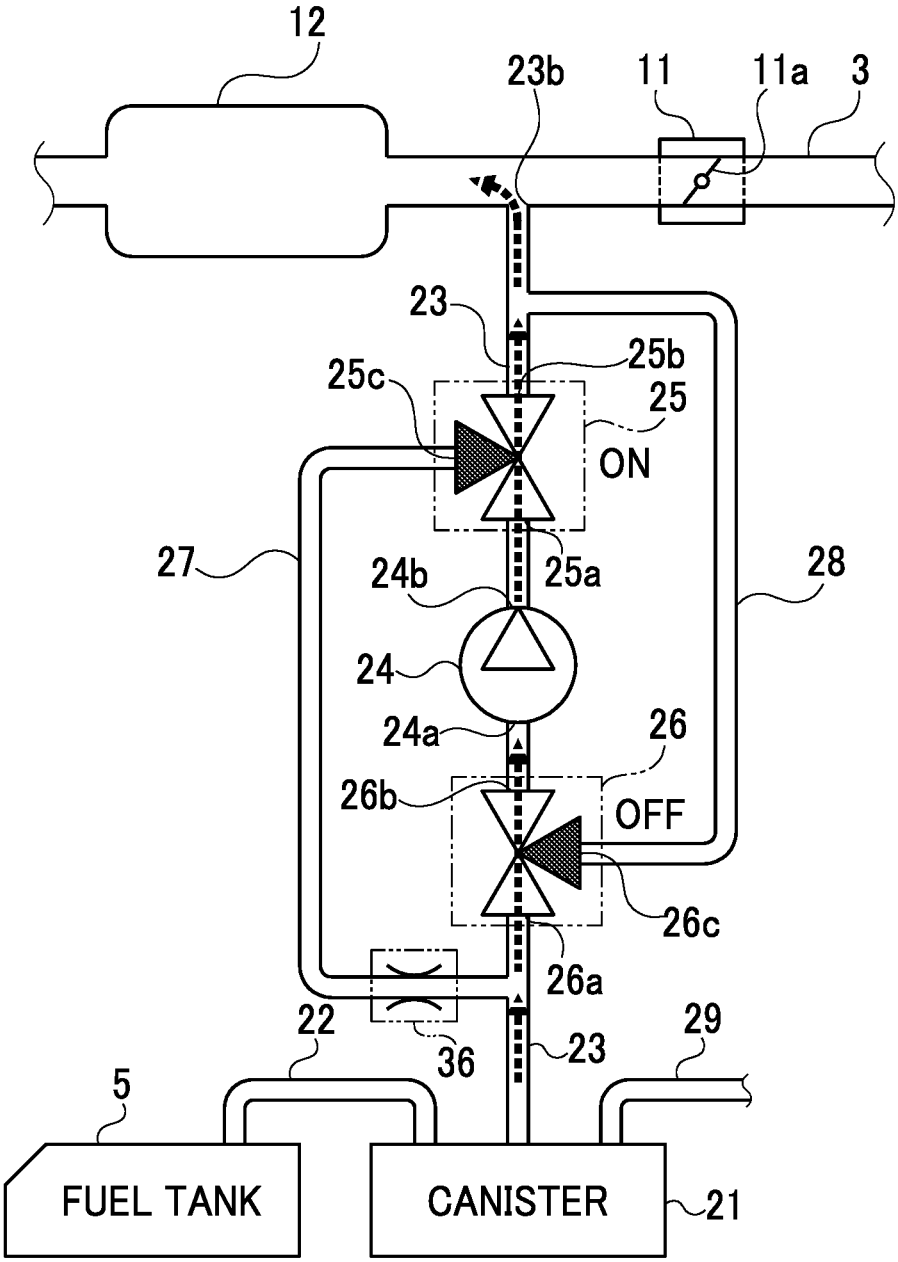
FIG. 4 is a schematic view showing a flow of the vapor and others in the evaporated fuel processing apparatus in a purge mode state in the first embodiment.

FIG. 4 is a schematic view showing a flow of the vapor or the like (indicated with an arrow) in the evaporated fuel processing apparatus 20 under the purge mode state. As shown in FIG. 4, the vapor having flown out of the canister 21 to the purge passage 23 flows through the purge passage 23 via the second trifurcated valve 26, the purge pump 24, and the first trifurcated valve 25, and then the vapor is purged into the intake passage 3.

In step 160, the ECU 50 determines whether the taken engine air-fuel ratio is within a reference value. The ECU 50 shifts the process to step 170 when this determination result is affirmative, and shifts the process to step 230 when the determination result is negative.

In step 230, the ECU 50 carries out a "backflow mode" operation to scavenge residual gas in a pipe for instant halt of purging according to a result of the engine air-fuel ratio. This backflow mode is a mode to allow the vapor or the air to be purged to the intake passage 3 backward to the canister 21 through the purge passage 23 and others. The ECU 50 thus turns off the first trifurcated valve 25 and turns on the second trifurcated valve 26.

Figure 5:
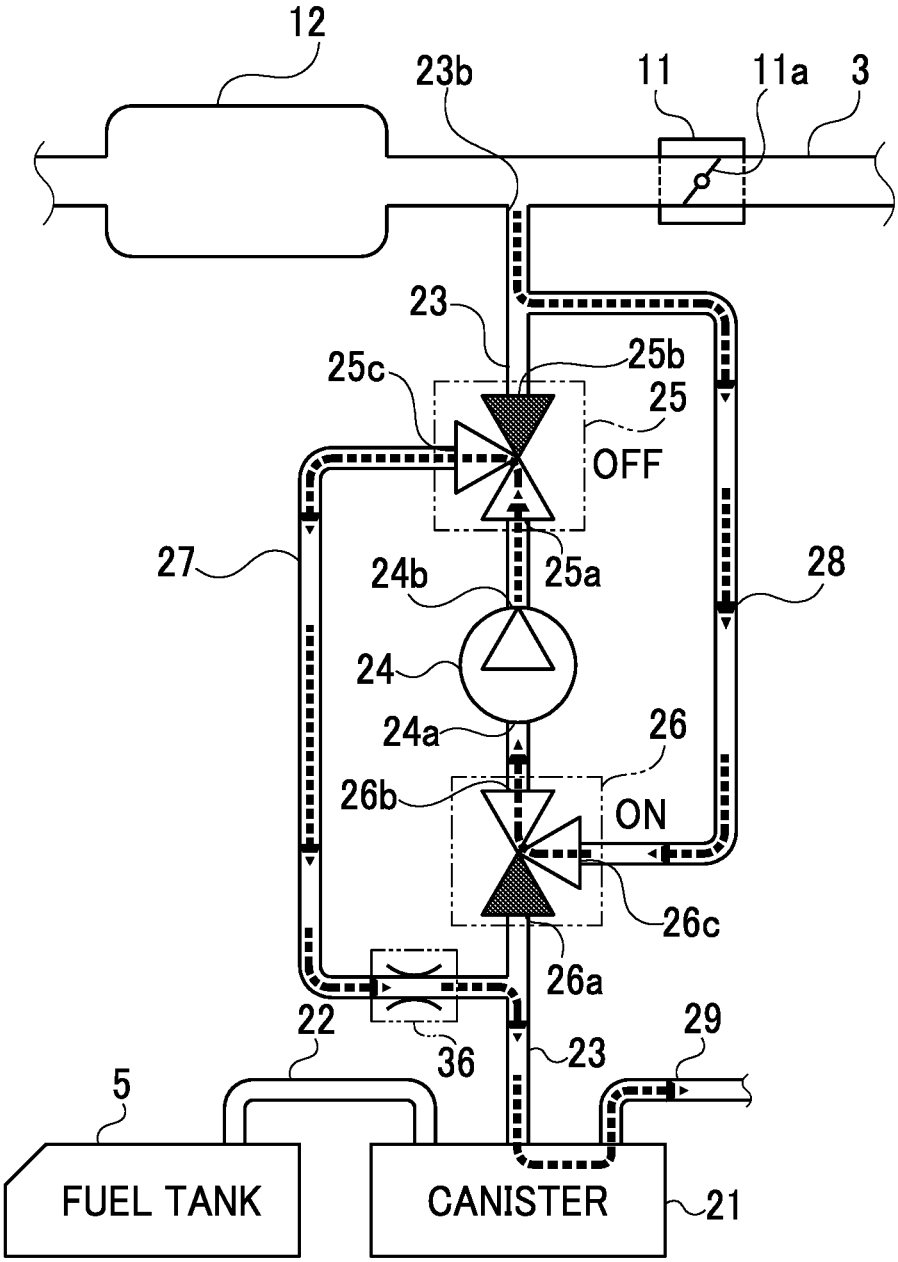
FIG. 5 is a schematic view showing a flow of the vapor and others in the evaporated fuel processing apparatus in a backflow mode state in the first embodiment.

FIG. 5 is a schematic view showing a flow of the vapor or the like (indicated with an arrow) in the evaporated fuel processing apparatus 20 under the backflow mode state. As shown in FIG. 5, the vapor or the air to be purged into the intake passage 3 is made to flow backward to the purge passage 23 and return to the canister 21 via the second bypass passage 28, the second trifurcated valve 26, the purge pump 24, the first trifurcated valve 25, the first bypass passage 27, and the purge passage 23.

Subsequently, in step 170 shifted from step 160, step 230, or step 240, the ECU 50 determines whether the engine 1 is stopped. The ECU 50 can make this determination based on the detected values of the various sensors 41 to 46. The ECU 50 shifts the process to step 180 when this determination result is affirmative, and returns the process to step 130 when the determination result is negative.

In step 180, the ECU 50 determines whether a purge-mode execution history exists before halt of the engine. The ECU 50 shifts the process to step 190 when this determination result is affirmative, and makes a jump to step 210 when the determination result is negative.

In step 190, the ECU 50 carries out the "backflow mode." The ECU 50 thus turns off the first trifurcated valve 25 and turns on the second trifurcated valve 26.

In step 200, the ECU 50 determines whether scavenging inside the pipes (the purge passage 23, the bypass passages 27 and 28, and others) under the backflow mode is completed. The ECU 50 specifically determines whether a predetermined time has elapsed for the above determination.

Subsequently, in step 210 shifted from step 180 or step 200, the ECU 50 turns off the purge pump 24. In other words, the ECU 50 halts the purge pump 24. In steps 180 to 210, when the ECU 50 carries out purging before halt of the engine 1, the ECU 50 carries out the backflow mode for the following scavenging of the pipes and then halts the purge pump 24. On the other hand, when the purging is not performed before halt of the engine 1, the ECU 50 halts the purge pump 24 without carrying out the backflow mode operation for the subsequent scavenging of the pipes.

In step 220, the ECU 50 carries out the "idle mode" operation. The ECU 50 turns off the first trifurcated valve 25 and turns off the second trifurcated valve 26. A purge path for the vapor from the purge passage 23 to the intake passage 3 is accordingly shut off. Thereafter, the ECU 50 returns the process to step 100.

According to the above-mentioned purge control, the ECU 50 is configured to turn on the purge pump 24 and switch the state of the first trifurcated valve 25 and the second trifurcated valve 26 to the predetermined state (the first trifurcated valve 25 is turned on and the second trifurcated valve 26 is turned off) during operation of the engine 1 so that the vapor collected in the canister 21 is purged to the intake passage 3 only via the purge passage 23 (for executing the purge mode operation). The ECU 50 is further configured to turn on the purge pump 24 and switch the state of the first trifurcated valve 25 and the second trifurcated valve 26 to the predetermined state (the first trifurcated valve 25 is turned off and the second trifurcated valve 26 is turned off) during operation of the engine 1 so that the vapor or the air is circulated between the purge passage 23 and the first bypass passage 27 (for executing the idle mode operation). In addition, the ECU 50 is configured to turn on the purge pump 24 and switch the state of the first trifurcated valve 25 and the second trifurcated valve 26 to the predetermined state (the first trifurcated valve 25 is turned off and the second trifurcated valve 26 is turned on) so that the vapor to be purged into the intake passage 3 is made to flow backward through the purge passage 23, the first bypass passage 27, and the second bypass passage 28 (for executing the backflow operation).

(Vapor-Concentration Estimation Control)

Figure 6:
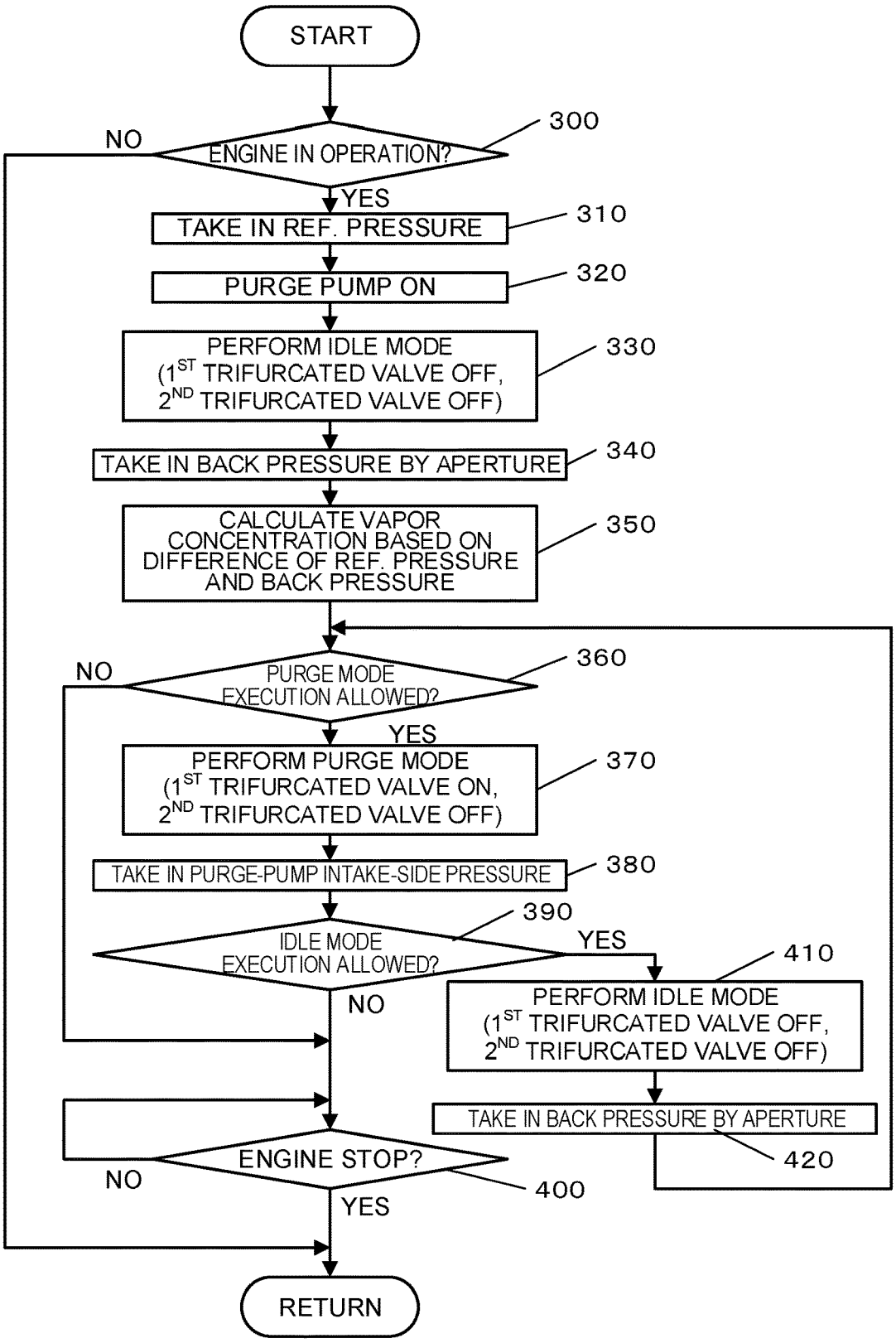
FIG. 6 is a flow chart showing a content of vapor concentration estimation control in the first embodiment.

A vapor-concentration estimation control is now explained. FIG. 6 is a flow chart showing a control content of the vapor-concentration estimation control. The ECU 50 periodically carries out this routine per predetermined period of time.

When the process is shifted to this routine, in step 300, the ECU 500 determines whether the engine 1 is under operation. The ECU 50 shifts the process to step 310 when this determination result is affirmative, and returns the process to step 300 when the determination result is negative, namely, when the engine 1 is stopped.

In step 310, the ECU 50 takes in a reference pressure in the pipe based on the detected value of the pressure sensor 47.

In step 320, the ECU 50 turns on the purge pump 24, namely, operates the purge pump 24. At this time, the ECU 50 controls the rotation number of the purge pump 24 to be a predetermined number.

In step 330, the ECU 50 carries out the "idle mode" operation for cooling down the purge pump 24. The ECU 50 thus turns off the first trifurcated valve 25 and turns off the second trifurcated valve 26.

In step 340, the ECU 50 takes in a back pressure by the aperture 36 based on the detected value of the pressure sensor 47.

In step 350, the ECU 50 calculates a vapor concentration by referring to a predetermined formula or a predetermined map based on a pressure difference of the reference pressure and the back pressure.

In step 360, the ECU 50 determines whether execution of the purge mode is allowed. The ECU 50 shifts the process to step 370 when this determination result is affirmative, and shifts the process to step 400 when the determination result is negative.

In step 370, the ECU 50 carries out the "purge mode" operation to purge the vapor to the intake passage 3. The ECU 50 thus turns on the first trifurcated valve 25 and turns off the second trifurcated valve 26.

In step 380, the EUC 50 takes in an intake-side pressure of the purge pump 24 based on the detected value of the pressure sensor 47. This intake-side pressure corresponds to pressure loss of the canister 21 and the pressure in the fuel tank 5.

In step 390, the ECU 50 determines whether execution of the idle mode is allowed. The ECU 50 permits execution of the idle mode when a predetermined idle condition is established. The ECU 50 shifts the process to step 410 when this determination result is affirmative, and shifts the process to step 400 when the determination result is negative.

In step 400 shifted from step 360 or step 390, the ECU 50 waits for halt of the engine 1, and then returns the process to step 300.

On the other hand, in step 410 shifted from step 390, the ECU 50 carries out the "idle mode" operation. The ECU 50 turns off the first trifurcated valve 25 and turns off the second trifurcated valve 26 for this operation.

In step 420, the ECU 50 takes in the back pressure generated by the aperture 36 based on the detected value of the pressure sensor 47. The ECU 50 then shifts the process to step 360.

To be specific, the ECU 50 is configured to estimate the vapor concentration during purging by the processes of step 360 to step 420.

According to the above-mentioned vapor-concentration estimation control, the ECU 50 carries out the idle mode operation during operation of the engine 1 and estimates the vapor concentration based on the pressure detected by the pressure sensor 47 at that time.

(Abnormality Diagnosis Control)

Figure 7:
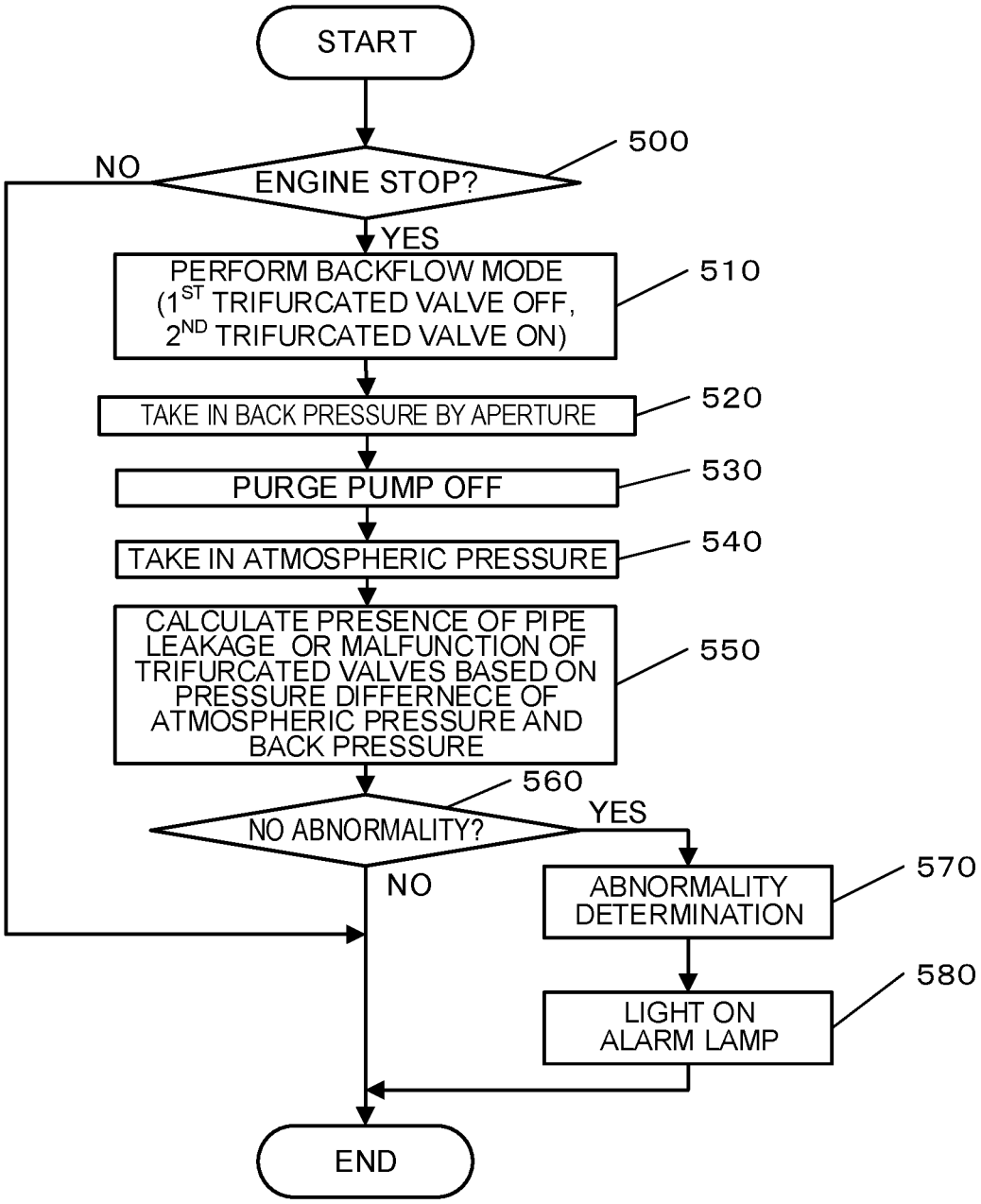
FIG. 7 is a flow chart showing a content of abnormality determination control of the evaporated fuel processing apparatus in the first embodiment.

An abnormality diagnosis control of the evaporated fuel processing apparatus 20 is now explained. FIG. 7 is a flow chart indicating the control content. The ECU 50 periodically carries out this routine per predetermined period of time.

When the process is shifted to this routine, in step 500, the ECU 50 determines whether the engine 1 is stopped. The ECU 50 shifts the process to step 510 when this determination result is affirmative, namely, when the engine 1 is stopped, and once terminates the following processes when the determination result is negative.

In step 510, the ECU 50 carries out the "backflow mode" to perform the abnormality determination. The ECU 50 turns off the first trifurcated valve 25 and turns on the second trifurcated valve 26 for this operation.

In step 520, the ECU 50 takes in the back pressure generated by the aperture 36 based on the detected value of the pressure sensor 47.

In step 530, the ECU 50 turns off the purge pump 24. Specifically, the ECU 50 halts the purge pump 24.

In step 540, the ECU 50 takes the atmospheric pressure based on the detected value of the pressure sensor 47.

In step 550, the ECU 50 calculates presence or absence of leakage in pipes or malfunction (abnormality) on each of the trifurcated valves 25 and 26 by referring to a predetermined formula or a predetermined map based on the pressure difference of the atmospheric pressure and the back pressure.

In step 560, the ECU 50 determines whether there is no above abnormality (leakage in the pipes or malfunction on each of the trifurcated valves 25 and 26). The ECU 50 once terminates the subsequent processes when this determination result is negative, and shifts the process to step 570 when the determination result is affirmative.

In step 570, the ECU 50 diagnoses that the abnormality has occurred in the evaporated fuel processing apparatus 20. The ECU 50 can store this determination result in a memory.

In step 580, the ECU 50 lights on a warning lamp 56 and once terminates the subsequent processes.

According to the above-mentioned abnormality diagnosis control, the ECU 50 is configured to carry out the backflow mode when the engine 1 is stopped and to diagnose abnormality (leakage in the pipes or presence or absence of the malfunction in each of the trifurcated valves 25 and 26) in the evaporated fuel processing apparatus 20 based on the back pressure detected by the pressure sensor 47 at that time and the atmospheric pressure detected by the pressure sensor 47 when the purge pump 24 is halted.

According to the above-mentioned evaporated fuel processing apparatus 20 of the present embodiment, a passage for the vapor or the air formed with at least any one of the purge passage 23, the first bypass passage 27, and the second bypass passage 28 is selectively configured by appropriately switching the passages of the first trifurcated valve 25 and the second trifurcated valve 26 during operation of the purge pump 24. Further, the relatively small number of components of the first bypass passage 27, the second bypass passage 28, the first trifurcated valve 25, and the second trifurcated valve 26 other than the purge passage 23 and the purge pump 24 constitute a plurality of passages. Specifically, during operation of the purge pump 24, the passages of the first trifurcated valve 25 and the second trifurcated valve 26 are switched to the predetermined state, so that a passage allowing the vapor collected in the canister 21 to be purged to the intake passage 3 only via the purge passage 23 can be configured. Further, during operation of the purge pump 24, the passages of the first trifurcated valve 25 and the second trifurcated valve 26 are switched to the predetermined state, so that a passage allowing the vapor or the air to circulate between the purge passage 23 and the first bypass passage 27 can be configured. Furthermore, during operation of the purge pump 24, the passages of the first trifurcated valve 25 and the second trifurcated valve 26 are switched to the predetermined state, so that a passage allowing the vapor which is to be purged into the intake passage 3 to flow backward via the purge passage 23, the first bypass passage 27, and the second bypass passage 28 can be configured. Accordingly, the relatively simple configuration including the purge pump 24 achieves switching not only to the passage allowing the vapor to be purged to the intake passage 3 but also to the passage capable of cooling down the purge pump 24 during purging halt and improving the responsivity of purging halt.

According to the above-mentioned purging control, the ECU 50 turns on the purge pump 24 and switches the passages of the first trifurcated valve 25 and the second trifurcated valve 26 to the predetermined state (the first trifurcated valve 25 is turned on and the second trifurcated valve 26 is turned on) during operation of the engine 1, namely the ECU 50 carries out the purge mode, so that a passage can be configured to purge the vapor collected in the canister 21 to the intake passage 3 only via the purge passage 23. In other words, the vapor collected in the canister 21 is sucked into the purge passage 23 by the purge pump 24, and then flows through the purge passage 23, the second trifurcated valve 26, the purge pump 24, the first trifurcated valve 25, and the purge passage 23 in this order to be purged into the intake passage 3. The vapor collected in the canister 21 is therefore purged effectively into the intake passage 3 via the purge passage 23 and used for combustion in the engine 1 according to the operation state of the engine 1 as similar to a conventional evaporated fuel processing apparatus provided with a purge pump and a purge valve.

Further, according to the above-mentioned purge control, the ECU 50 turns on the purge pump 24 and switches the passages of the first trifurcated valve 25 and the second trifurcated valve 26 to the predetermined state (the first trifurcated valve 25 is turned off and the second trifurcated valve 26 is turned off), namely, the ECU 50 carries out the idle mode operation, so that the passage of circulating the vapor or the air between the purge passage 23 and the first bypass passage 27 is configured. Specifically, the vapor collected in the canister 21 is sucked into the purge passage 23 by the purge pump 24 and then flows through and circulates the purge passage 23, the second trifurcated valve 26, the purge pump 24, the first trifurcated valve 25, the first bypass passage 27, and the purge passage 23. Accordingly, even when purging is halted during operation of the engine 1, the purge pump 24 can be cooled down by the circulation of the vapor or the air until the next purging is carried out, thus enhancing the endurability of the purge pump 24.

According to the above-mentioned purge control, the ECU 50 turns on the purge pump 24 and switches the passages of the first trifurcated valve 25 and the second trifurcated valve 26 to the predetermined state (the first trifurcated valve 25 is turned off and the second trifurcated valve 26 is tuned on), namely, the ECU 50 carries out the backflow mode operation, so that the passage of allowing the vapor that is to be purged to the intake passage 3 to flow backward through the purge passage 23, the first bypass passage 27, and the second bypass passage 28 is configured. Specifically, the vapor purged into the intake passage 3 from the purge passage 23 is brought back to the purge passage 23 by the purge pump 24, and thus the vapor flows backward to the canister 21 through the purge passage 23, the second bypass passage 28, the second trifurcated valve 26, the purge pump 24, the first trifurcated valve 25, the first bypass passage 27, and the purge passage 23 in this order. Accordingly, when the supply amount of the vapor is to be reduced for preventing disturbance in the engine air-fuel ratio during operation of the engine 1, the vapor is made to flow backward to promptly stop purging the vapor to the intake passage 3, thereby shutting off supply of the vapor to the engine 1 with high responsivity. Further, when the engine 1 stops, the vapor remaining in the pipes (the respective passages 23, 27, 28, and others) can be returned to the canister 21 in a short time. As a result of this, control accuracy of the purge ratio is improved for the subsequent purging of the vapor.

According to the above-mentioned evaporated fuel processing apparatus 20, the aperture 36 is provided in the first bypass passage 27 and the single pressure sensor 47 is provided in the first bypass passage 27 between the first trifurcated valve 25 and the aperture 36. Thus, flow of the vapor or the air in the first bypass passage 27 is restricted by the aperture 36 such that the pressure on the intake side and the exhaust side of the purge pump 24 is measured by the single pressure sensor 47 by switching the passages of the first trifurcated valve 25 and the second trifurcated valve 26, thus enabling measurement of the pressure difference (pressure increased by the purge pump). Consequently, the vapor concentration in the purge passage 23 can be estimated by the single pressure sensor 47.

According to the above-mentioned vapor concentration estimation control, only by use of the single pressure sensor 47, the reference pressure can be detected during halt of the purge pump 24, and the back pressure generated by the aperture 36 can be detected during execution of the idle mode. The vapor concentration can be calculated based on the pressure difference of the reference pressure and the back pressure. Further, during execution of the purge mode, the intake-side pressure of the purge pump 24 (the pressure on a side of the intake port 24*a*) can be detected by the pressure sensor 47. By these detection results, pressure loss caused by degradation in the canister 21 and others can be detected.

According to the above-mentioned abnormality diagnosis control, during halt of the engine 1, operation of the backflow mode by use of the single pressure sensor 47 enables detection of the back pressure generated by the aperture 36. Further, the atmospheric pressure can be detected by turning off (halt) the purge pump 24. Based on the pressure difference of those atmospheric pressure and the back pressure, it is possible to diagnose abnormality of the evaporated fuel processing apparatus 20, specifically the leakage of the pipes or presence or absence of the malfunction of the trifurcated valves 25 and 26.

Second Embodiment

A second embodiment embodying an evaporated fuel processing apparatus is explained in detail with reference to the accompanying drawings. In the following explanation, the same or similar constituent elements to the first embodiment are assigned with the same reference numerals and omitted their explanation, and the explanation will be made focusing on the different points from the first embodiment.

(Configuration of Evaporated Fuel Processing Apparatus)

Figure 8:
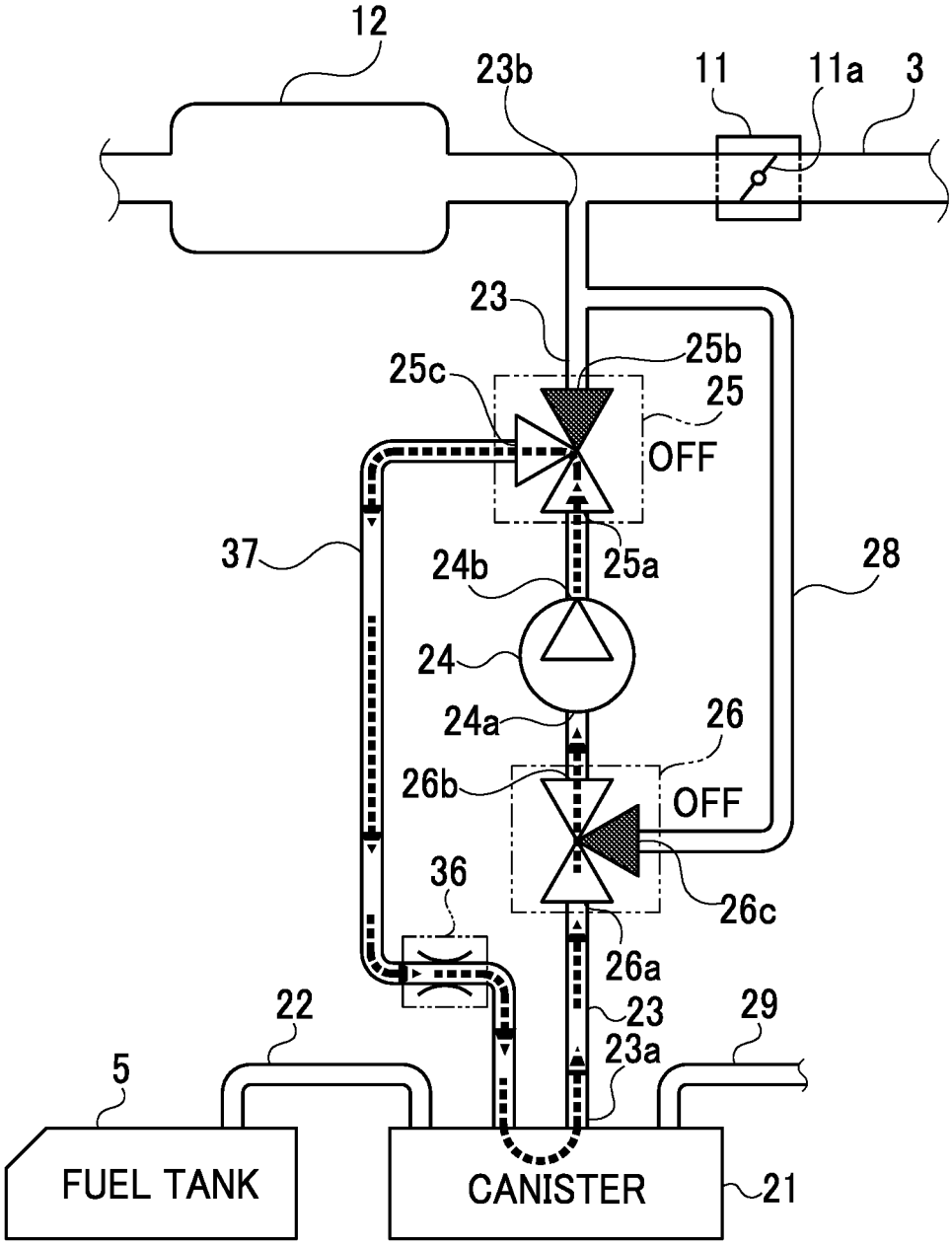
FIG. 8 is a schematic view showing a flow of the vapor and others in the evaporated fuel processing apparatus in the idle mode state in a second embodiment.

FIG. 8 is a schematic view corresponding to FIG. 3, showing a flow (indicated with an arrow) of the vapor or the like in the evaporated fuel processing apparatus 20 in the idle mode state. As shown in FIG. 8, in the present embodiment, a third bypass passage 37 is provided to detour the purge pump 24 between the canister 21 upstream of the second trifurcated valve 26 (a vicinity of a connection part with the inflow port 23*a* of the purge passage 23) and the first trifurcated valve 25. Further, in the present embodiment, the ECU 50 turns off the first trifurcated valve 25 and turns off the second trifurcated valve 26 to carry out the idle mode. In this case, as shown in FIG. 8, the vapor having flown out of the canister 21 to the purge passage 23 further flows to the canister 21 through the second trifurcated valve 26, the purge pump 24, the first trifurcated valve 25, and the third bypass passage 37 so that the vapor circulates the above-explained route. Other configuration of the evaporated fuel processing apparatus of the present embodiment is similar to that of the first embodiment.

Accordingly, in the present embodiment, the purge pump 24 is turned on and the passages of the first trifurcated valve 25 and the second trifurcated valve 26 are switched to the predetermined state (the first trifurcated valve 25 is turned off and the second trifurcated valve 26 is turned off) during operation of the engine 1, in other words, the idle mode is carried out. Thus, as shown in FIG. 8, a passage capable of circulating the vapor or the air among the purge passage 23, the third bypass passage 37, and the canister 21 is configured. Specifically, the vapor collected in the canister 21 is sucked into the purge passage 23 by the purge pump 24 and flows through the purge passage 23, the second trifurcated valve 26, the purge pump 24, the first trifurcated valve 25, the third bypass passage 37, and the canister 21. The vapor circulates according to this route. Accordingly, even when the purging halts during operation of the engine 1, the purge pump 24 can be cooled down by the circulation of the vapor or the air until the subsequent purging is carried out, thus enhancing the endurability of the purge pump 24. Moreover, when the purging halts, separation of the vapor from the canister 21 can be promoted by heat of the purge pump 24, and the purge pump 24 can be further cooled down by the air which has been cooled down by the separation, so that the endurability of the purge pump 24 is further improved.

This disclosed technique is not limited to the above embodiments and may be embodied with appropriate modification to a part of its configuration without departing from the scope of the disclosed technique.

In the above embodiments, an engine system with no supercharger is configured such that a purge passage 23 is communicated with an intake passage 3 downstream of a throttle valve 11*a* in order to purge vapor. Alternatively, an engine system provided with a supercharger may also be configured such that a purge passage is communicated with an intake passage upstream of a throttle valve and downstream of an air flow meter to purge the vapor.

INDUSTRIAL APPLICABILITY

The present disclosure is applied to an engine system configured to supply fuel from a fuel tank to an engine.

REFERENCE SIGNS LIST

1 Engine
3 Intake passage
5 Fuel tank
20 Evaporated fuel processing apparatus
21 Canister
23 Purge passage
23*a* Inflow port
23*b* Outflow port
24 Purge pump
24*a* Intake port
24*b* Exhaust port
25 First trifurcated valve
25*a* Inlet
25*b* First outlet
25*c* Second outlet
26 Second trifurcated valve
26*a* First inlet
26*b* Outlet
26*c* Second inlet
27 First bypass passage
28 Second bypass passage
36 Aperture
37 Third bypass passage
47 Pressure sensor
50 ECU (Control Unit)

What is claimed is:

1. An evaporated fuel processing apparatus to purge and process evaporated fuel generated in a fuel tank to an intake passage of an engine, the evaporated fuel processing apparatus comprising:

a canister to collect the evaporated fuel generated in the fuel tank;

a purge passage to purge the evaporated fuel collected in the canister to the intake passage, the purge passage including an inflow port to introduce the evaporated fuel from the canister and an outflow port to discharge the evaporated fuel out of the intake passage;

a purge pump arranged in the purge passage to pressure-feed the evaporated fuel collected in the canister to the purge passage, the purge pump including an intake port and an exhaust port and configured to intake the evaporated fuel collected in the canister from the intake port and to discharge the evaporated fuel from the exhaust port;

a first trifurcated valve arranged in the purge passage between the exhaust port of the purge pump and the outflow port of the purge passage;

a second trifurcated valve arranged in the purge passage between the inflow port of the purge passage and the intake port of the purge pump;

a first bypass passage detouring the purge pump between the purge passage upstream of the second trifurcated valve and the first trifurcated valve; and a second bypass passage detouring the purge pump between the purge passage downstream of the first trifurcated valve and the second trifurcated valve, wherein passages of the evaporated fuel or the air passing through at least any one of the purge passage, the first bypass passage, and the second bypass passage are configured to be switched by switching passages of the first trifurcated valve and the second trifurcated valve during operation of the purge pump.

2. The evaporated fuel processing apparatus according to claim 1, further comprising:

a processor programmed to:

control the purge pump, the first trifurcated valve, and the second trifurcated valve according to an operation state of the engine, wherein:

the first trifurcated valve includes an inlet and a first outlet which are connected to the purge passage and a second outlet connected to the first bypass passage, the first trifurcated valve being configured to switch the passages of the first trifurcated valve such that a state of communicating the inlet with the first outlet and a state of communicating the inlet with the second outlet are switchable, the second trifurcated valve includes a first inlet and an outlet which are connected to the purge passage and a second inlet connected to the second bypass passage, the second trifurcated valve being configured to switch the passages of the second trifurcated valve such that a state of communicating the second inlet with the outlet and a state of communicating the first inlet with the outlet are switchable, and the processor is programmed to:

turn on the purge pump and switch the passages of the first trifurcated valve and the second trifurcated valve to the predetermined state during operation of the engine such that the evaporated fuel collected in the canister is purged to the intake passage only through the purge passage.

3. The evaporated fuel processing apparatus according to claim 2, wherein the processor is programmed to:

turn on the purge pump and to switch the passages of the first trifurcated valve and the second trifurcated valve to the predetermined state during operation of the engine such that the evaporated fuel or the air is circulated between the purge passage and the first bypass passage.

4. The evaporated fuel processing apparatus according to claim 2, wherein the processor is programmed to:

turn on the purge pump and switch the passages of the first trifurcated valve and the second trifurcated valve to the predetermined state so that the evaporated fuel purged to the intake passage flows backward through the purge passage, the first bypass passage, and the second bypass passage.

5. The evaporated fuel processing apparatus according to claim 1, further comprising:

an aperture provided in the first bypass passage; and a pressure sensor configured to detect pressure in the first bypass passage between the first trifurcated valve and the aperture.

6. The evaporated fuel processing apparatus according to claim 3, wherein the processor is programmed to:

turn on the purge pump and switch the passages of the first trifurcated valve and the second trifurcated valve to the predetermined state so that the evaporated fuel purged to the intake passage flows backward through the purge passage, the first bypass passage, and the second bypass passage.

7. The evaporated fuel processing apparatus according to claim 2, further comprising:

an aperture provided in the first bypass passage; and a pressure sensor configured to detect pressure in the first bypass passage between the first trifurcated valve and the aperture.

8. The evaporated fuel processing apparatus according to claim 3, further comprising:

an aperture provided in the first bypass passage; and a pressure sensor configured to detect pressure in the first bypass passage between the first trifurcated valve and the aperture.

9. The evaporated fuel processing apparatus according to claim 4, further comprising:

an aperture provided in the first bypass passage; and a pressure sensor configured to detect pressure in the first bypass passage between the first trifurcated valve and the aperture.

10. The evaporated fuel processing apparatus according to claim 6, further comprising:

an aperture provided in the first bypass passage; and a pressure sensor configured to detect pressure in the first bypass passage between the first trifurcated valve and the aperture.

11. An evaporated fuel processing apparatus to purge and process evaporated fuel generated in a fuel tank to an intake passage of an engine, the evaporated fuel processing apparatus comprising:

a canister to collect the evaporated fuel generated in the fuel tank;

a purge passage to purge the evaporated fuel collected in the canister to the intake passage, the purge passage including an inflow port to introduce the evaporated fuel from the canister and an outflow port to discharge the evaporated fuel out of the intake passage;

a purge pump arranged in the purge passage to pressure-feed the evaporated fuel collected in the canister to the purge passage, the purge pump including an intake port and an exhaust port and configured to intake the evaporated fuel collected in the canister from the intake port and to discharge the evaporated fuel from the exhaust port;

a first trifurcated valve arranged in the purge passage between the exhaust port of the purge pump and the outflow port of the purge passage;

a second trifurcated valve arranged in the purge passage between the inflow port of the purge passage and the intake port of the purge pump;

a third bypass passage detouring the purge pump between the canister and the first trifurcated valve;

a second bypass passage detouring the purge pump between the purge passage downstream of the first trifurcated valve and the second trifurcated valve; and a processor programmed to:

control the purge pump, the first trifurcated valve, and the second trifurcated valve according to an operation state of the engine, wherein:

passages of the evaporated fuel or the air passing through at least any one of the purge passage, the third bypass passage, and the second bypass passage are configured to be switched by switching passages of the first trifurcated valve and the second trifurcated valve during operation of the purge pump, the first trifurcated valve includes an inlet and a first outlet which are connected to the purge passage and a second outlet connected to the third bypass passage, the first trifurcated valve being configured to switch the passages of the first trifurcated valve such that a state of communicating the inlet with the first outlet and a state of communicating the inlet with the second outlet are switchable, the second trifurcated valve includes a first inlet and an outlet which are connected to the purge passage and a second inlet connected to the second bypass passage, the second trifurcated valve being configured to switch the passages of the second trifurcated valve such that a state of communicating the second inlet with the outlet and a state of communicating the first inlet with the outlet are switchable, and the processor is programmed to:

turn on the purge pump and switch the passages of the first trifurcated valve and the second trifurcated valve to the predetermined state during operation of the engine such that the evaporated fuel collected in the canister is purged to the intake passage only through the purge passage, and turn on the purge pump and to switch the passages of the first trifurcated valve and the second trifurcated valve to the predetermined state during operation of the engine such that the evaporated fuel or the air is circulated among the purge passage, the third bypass passage, and the canister.

12. The evaporated fuel processing apparatus according to claim 11, wherein the processor is programmed to:

turn on the purge pump and switch the passages of the first trifurcated valve and the second trifurcated valve to the predetermined state so that the evaporated fuel purged to the intake passage flows backward through the purge passage, the third bypass passage, and the second bypass passage.

13. The evaporated fuel processing apparatus according to claim 11, further comprising:

an aperture provided in the third bypass passage; and a pressure sensor configured to detect pressure in the third bypass passage between the first trifurcated valve and the aperture.

14. The evaporated fuel processing apparatus according to claim 12, further comprising:

an aperture provided in the third bypass passage; and a pressure sensor configured to detect pressure in the third bypass passage between the first trifurcated valve and the aperture.

15. The evaporated fuel process apparatus according to claim 1, wherein the first bypass passage is directly connected to the purge passage.

16. The evaporated fuel process apparatus according to claim 11, wherein the first bypass passage is directly connected to the purge passage.

17. The evaporated fuel processing apparatus according to claim 16, further comprising:

an aperture provided in the third bypass passage; and a pressure sensor configured to detect pressure in the third bypass passage between the first trifurcated valve and the aperture.

* * * * *